United States Patent [19]

Clark et al.

[11] 4,209,249

[45] Jun. 24, 1980

[54] METHOD AND APPARATUS FOR GENERATING DUPLEX COPIES ELECTROPHOTOGRAPHICALLY FROM SIMPLEX ORIGINALS

[75] Inventors: Gary A. Clark; Carl A. Queener, both of Longmont, Colo.

[73] Assignee: International Business Machines Corporation, Armonk, N.Y.

[21] Appl. No.: 903,277

[22] Filed: May 5, 1978

[51] Int. Cl.[2] ..... G03G 15/00

[52] U.S. Cl. ..... 355/14 R; 271/9; 355/23

[58] Field of Search ..... 355/14, 3 R, 23, 24, 355/25, 26; 271/3.1, 4, 9

[56] References Cited

U.S. PATENT DOCUMENTS

| | | | |
|---|---|---|---|
| 4,067,649 | 1/1978 | Hubbard | 271/9 X |
| 4,099,150 | 7/1978 | Connin | 271/3.1 X |
| 4,116,558 | 9/1978 | Adamek et al. | 355/24 |

OTHER PUBLICATIONS

*Research Disclosure,* "Apparatus for Producing Collated Copies From Two Sided Originals", pp. 77–79, May 1977.

*Primary Examiner*—R. L. Moses

*Attorney, Agent, or Firm*—O'Rourke & Harris

[57] ABSTRACT

A method and apparatus is disclosed for generating duplex copies from simplex originals. A plurality of originals are sequentially fed through the copying area of an electrophotographic copying machine during a first pass with a predetermined number of copies being electrophotographically made only with respect to each original appearing at an even number in the sequence as fed to the copying area and with the copies being made on one side of separate sheets of copy paper withdrawn from a storage receptacle. After collection of the sheets of copy paper from the copying area, these sheets are replaced in the storage receptacle and the plurality of originals again sequentially fed through the copying area of the copying machine during a second pass. During this second pass through the copying area, a predetermined number of electrophotographic copies equal to the number made during the first pass are made with respect to each original appearing at an odd number in the sequence as fed to the copying area with the copies being made on the side of the sheets opposite to that used during first pass copying, these sheets having been previously replaced in the storage receptacle and withdrawn therefrom for a second time during copying. Through proper orientation of the sheets replaced in the storage receptacle, duplex copies are therefore made from adjacent originals in the sequence of originals as fed to the copying area during each pass.

29 Claims, 10 Drawing Figures

METHOD AND APPARATUS FOR GENERATING DUPLEX COPIES ELECTROPHOTOGRAPHICALLY FROM SIMPLEX ORIGINALS

FIELD OF THE INVENTION

This invention relates to copy generation, and, more particularly, relates to electrophotographically generating duplex copies from simplex orginals.

BACKGROUND OF THE INVENTION

Reproduction, or copying, systems have been known and utilized for some time. Among the more successful of such systems is that accomplished electrophotographically, and many types of machines and methods for accomplishing the desired end have been proposed and/or utilized.

As would be expected, copying machines, including auxiliary devices used on connection therewith or as a part thereof, have undergone many refinements and, at least in some cases, while such refinements have greatly increased the usefulness of such machines, these refinements have also increased costs.

Included in the many refinements to copying machines that have heretofore been suggested or have occurred, is the development of auxiliary devices for feeding originals to the copying area of the copy machine, including automatic feeding, and development of collating, or collecting, devices to receive and handle the copy sheets forwarded from the copying area after copying has occurred. Document feeding devices are shown, for example, in U.S. Pat. Nos. 3,552,739; 3,556,511; 3,556,512; 3,556,513; 3,565,420; 3,630,515; and 3,815,896, while copy collecting devices are shown, again by way of example, in U.S. Pat. Nos. 3,460,824 and 3,841,754.

Also included in the many refinements in copying machines that have heretofore been suggested or have occurred is development in such machines of the capability to make duplex copies (i.e., to copy on both sides of a sheet of copy paper). This is important not only where exact copying is desired of duplex original documents but it is also important in other respects as, for example, in saving paper costs and/or filing space. Duplex copying is shown, for example, in U.S. Pat. Nos. 3,615,129; 3,645,615 and 3,841,754, with the latter including a feeding mechanism and a sorting, or collecting device in conjunction therewith.

Duplex copying from simplex originals can normally be accomplished today on many different types of copying machines. The degree of difficulty encountered, as well as the required handling of originals and/or copies, depends, however, at least in part, upon the degree of sophistication of the operator.

For example, assuming that an operator is not sophisticated in copy machine operation, but has available a copy machine with a manual/automatic feeding mechanism and a collator, the operator can produce duplex sets of copies from a simplex original set by: selecting the number of copies to be made; feeding the first original into the copying area and making the preselected number of copies; removing the copies from the collator and placing them in the copy paper storage tray; feeding the second original into the copying area and making the preselected number of copies each of which is copied on the opposite side of the copies made of the first original; removing the duplex copies from the collator; feeding the third original into the copying area and making the preselected number of copies; removing the copies from the collator and placing them in the copy paper storage tray; feeding the fourth original into the copying area and making the preselected number of copies again upon the side of the copy paper opposite to that of the copies made of the third original; removing these duplex copies from the collator; and then repeating the same process for each of the originals remaining. After copying is completed, the copies are hand collated into the duplex copy sets.

If the operator is more sophisticated, the task can be accomplished with less difficulty. For example, the operator can first hand sort the originals into two piles one of which includes the even numbered documents and the other of which includes the odd numbered documents, after which copying can be carried out by: sequentially copying the even numbered documents with the preselected number of copies of each being made on one side of separate sheets of copy paper; removing the copy paper from the collator and replacing the copy paper in the copy paper storage tray; selecting the collator mode (if available); and sequentially copying the odd numbered documents on the opposite side of the copy paper in the storage tray. If the collate mode is selected, the duplex copies can then be removed in sets from the collator, but the operator must still hand sort the originals to replace them in the proper order.

It is also well known that at least some commonly available commercial copying machines can provide automatic generation of duplex copies, but the required components and/or circuitry involved is complicated and results in costs for such units that are higher than might be justified for some users. In addition, in at least some of these units, auxiliary paper trays must be provided to achieve the duplexing operation and the copy paper must be removed therefrom before the duplexing operation is commenced, and/or if an odd number of documents are to be duplexed, procedures must be taken to assure removal of the last odd page from the collator or other collecting device.

Thus, while copying machines and methods have been suggested and/or utilized for generating duplex copies from simplex originals, the now known devices and methods have not proved to be entirely satisfactory, at least for all purposes, in that such devices and methods have either required extensive handling of originals and/or copies or have been of higher cost than justified for some users.

SUMMARY OF THE INVENTION

This invention provides an improved method and system for generating duplex copies from simplex originals which combines simplicity and ease of operation without unduly increasing the cost of generating the duplex copies or equipment that must be used in association therewith. The invention includes twice feeding originals through a copying area and causing a first group, consisting of alternative ones of the originals, to be copied on one side of copy paper during the first pass and causing a second group consisting of the remaining alternate ones of said originals, to be copied on the other side of the copy paper during the second pass to thus generate the duplex copies.

It is therefore an object of this invention to provide an improved method and apparatus for generating duplex copies.

It is still another object of this invention to provide an improved method and apparatus for generating duplex copies that is relatively simple yet enables ease of operation without undue cost.

It is still another object of this invention to provide an improved method and apparatus for copying different alternate ones of originals sequentially placed through a copying area of a copying machine to generate duplex copies.

With these and other objects in view, which will become apparent to one skilled in the art as the description proceeds, this invention resides in the novel construction, combination, and arrangement of parts substantially as hereinafter described and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
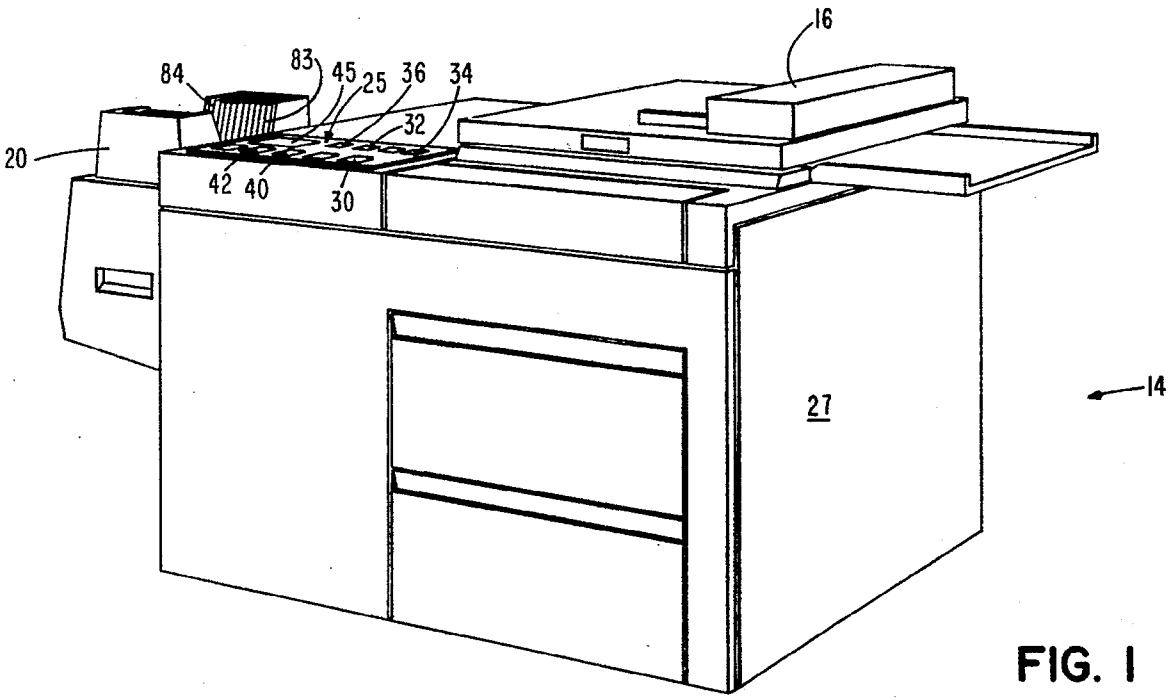
FIG. 1 is a perspective view of an electrophotographic copying machine having this invention incorporated therein.
Figure 2:
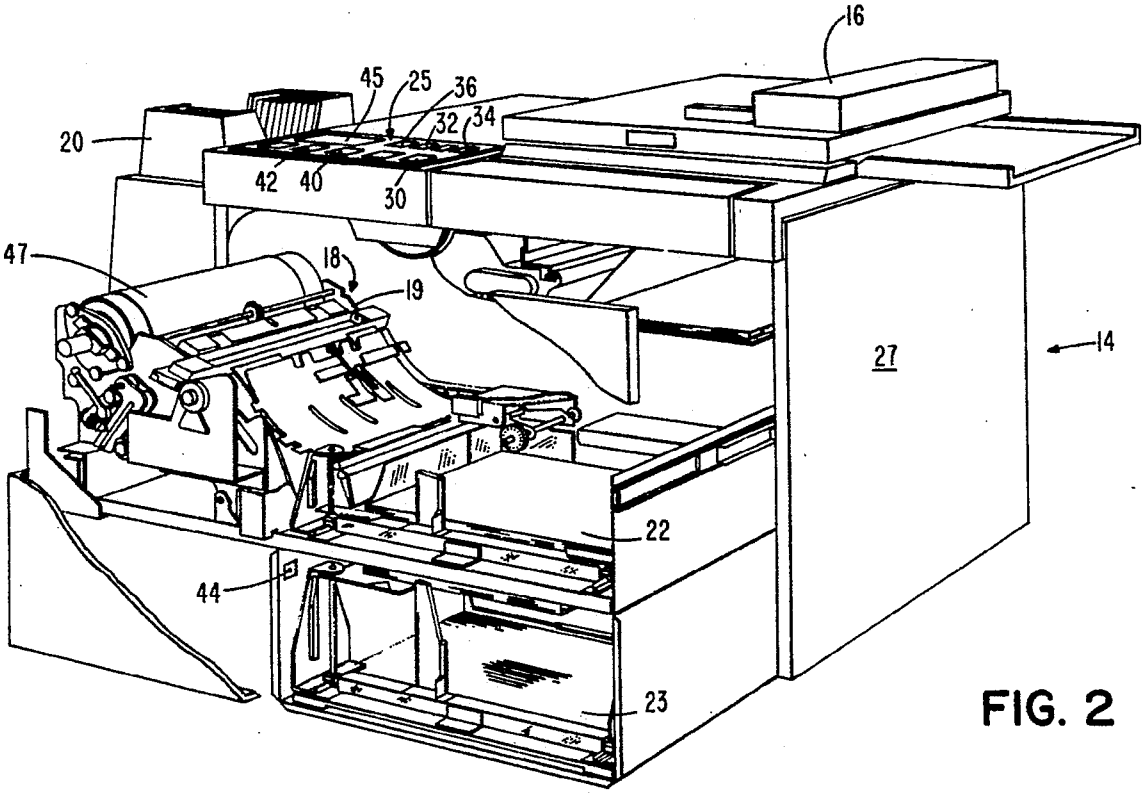
FIG. 2 is a partial disassembled view of the copying machine shown in FIG. 1 to illustrate features thereof.
Figure 3:
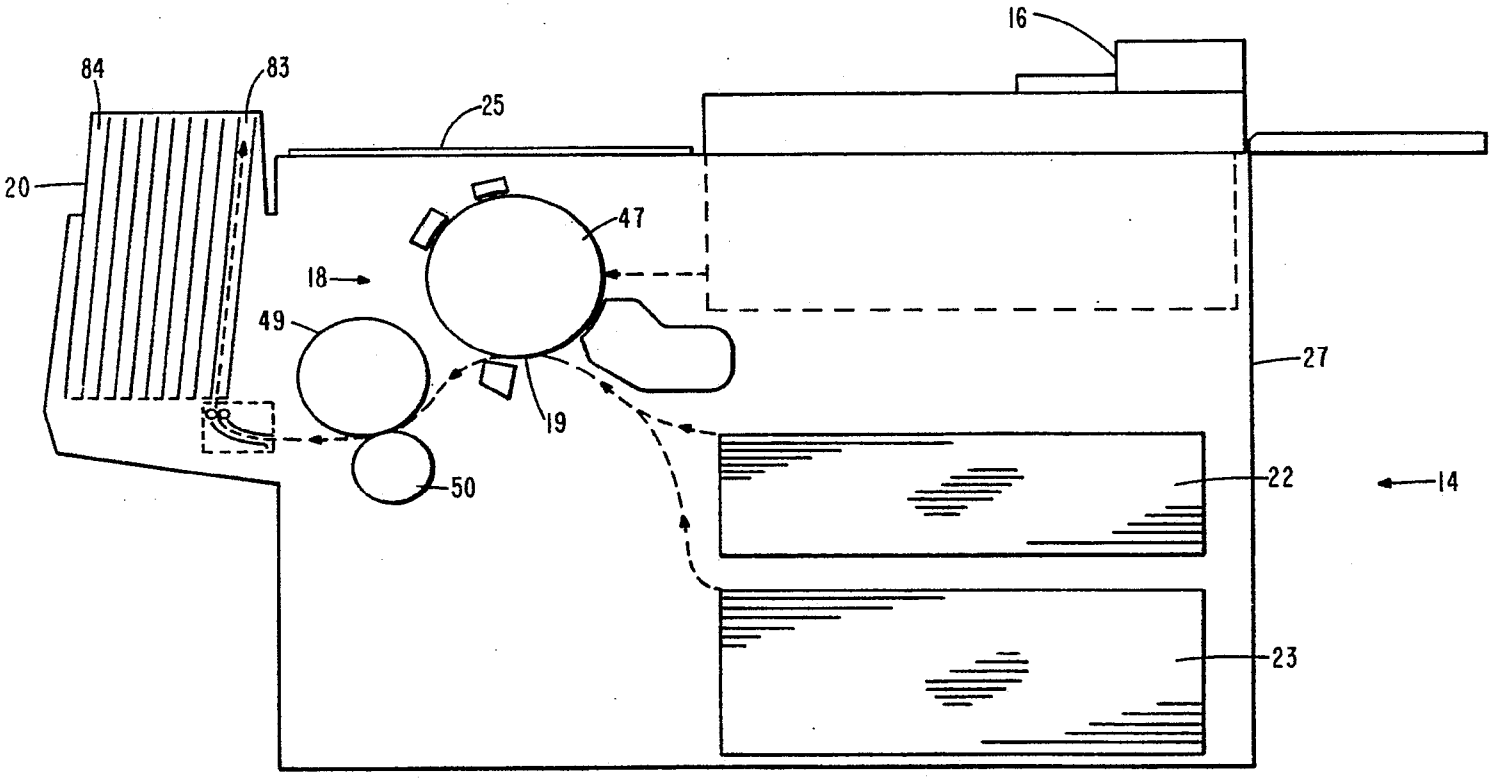
FIG. 3 is a schematic representation showing the path of copy paper from the storage tray through the copying area to the collator.

Referring now to the drawings, electrophotographic copying machine 14, as shown in FIGS. 1, 2 and 3, has this invention incorporated therein. As shown, copy machine 14 typically includes a document feeding mechanism 16, a copying area 18 having copying mechanism 19 thereat (see FIG. 2), a collector, or collator, 20, one or more copy paper receptacles, or trays, 22 and 23, a control panel 25 and a housing 27 enclosing the machine.

As is conventional, housing 27 includes a plurality of removable access panels and/or doors to permit access to the interior of the machine as is needed.

As is also conventional, control panel 25 has a plurality of switches and indicators thereon, such as a power on/off switch 30, a start print switch 32, a copy number selection switch 34, and various indicators 36 utilized in conjunction with the switches on the panel. In addition, for this invention, a duplex selection switch 40 and a second pass switch 42 may be provided on the control panel (or in the paper tray area as switch 44), as is a special message indicator 45 to instruct the operator at the end of the first pass of the duplexing operation.

Copying area 18 of the copy machine includes a rotatable drum 47 and associated stations for carrying out the electrophotographic copying on copy paper supplied from one of the storage trays 22 and 23 as is well known in the art. As indicated in FIG. 3, the copy paper is withdrawn from the storage tray and fed past drum 47 at the copying area 18 with the copy paper then being conveyed between fuser rollers 49 and 50 to collator 20.

Copy machines of this general type are well known and therefore have been detailed herein only to the extent necessary to better explain the invention incorporated therein.

Figure 4:
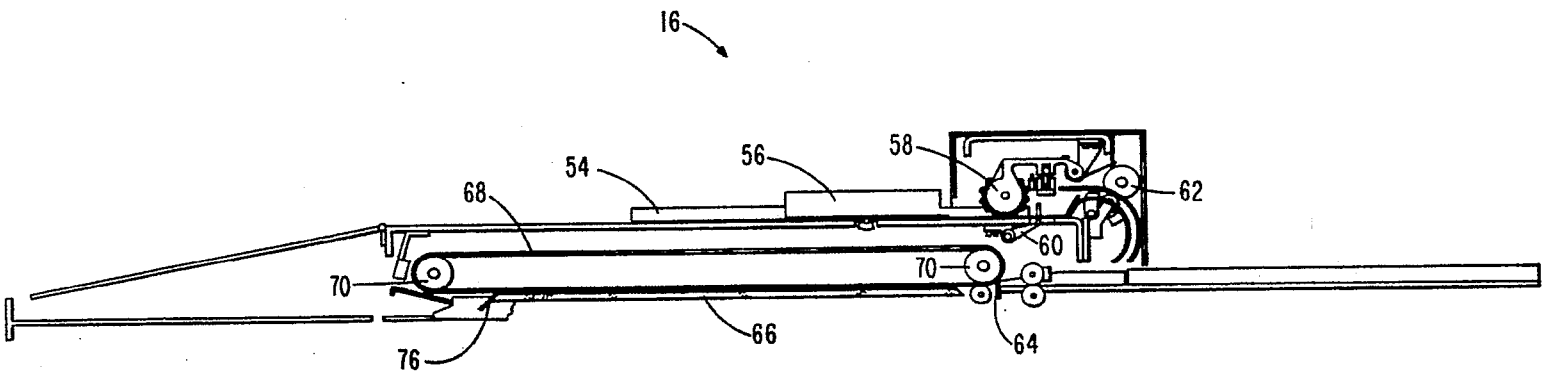
FIG. 4 is a side view with housing partially removed showing the automatic document feeding mechanism.
Figure 5:
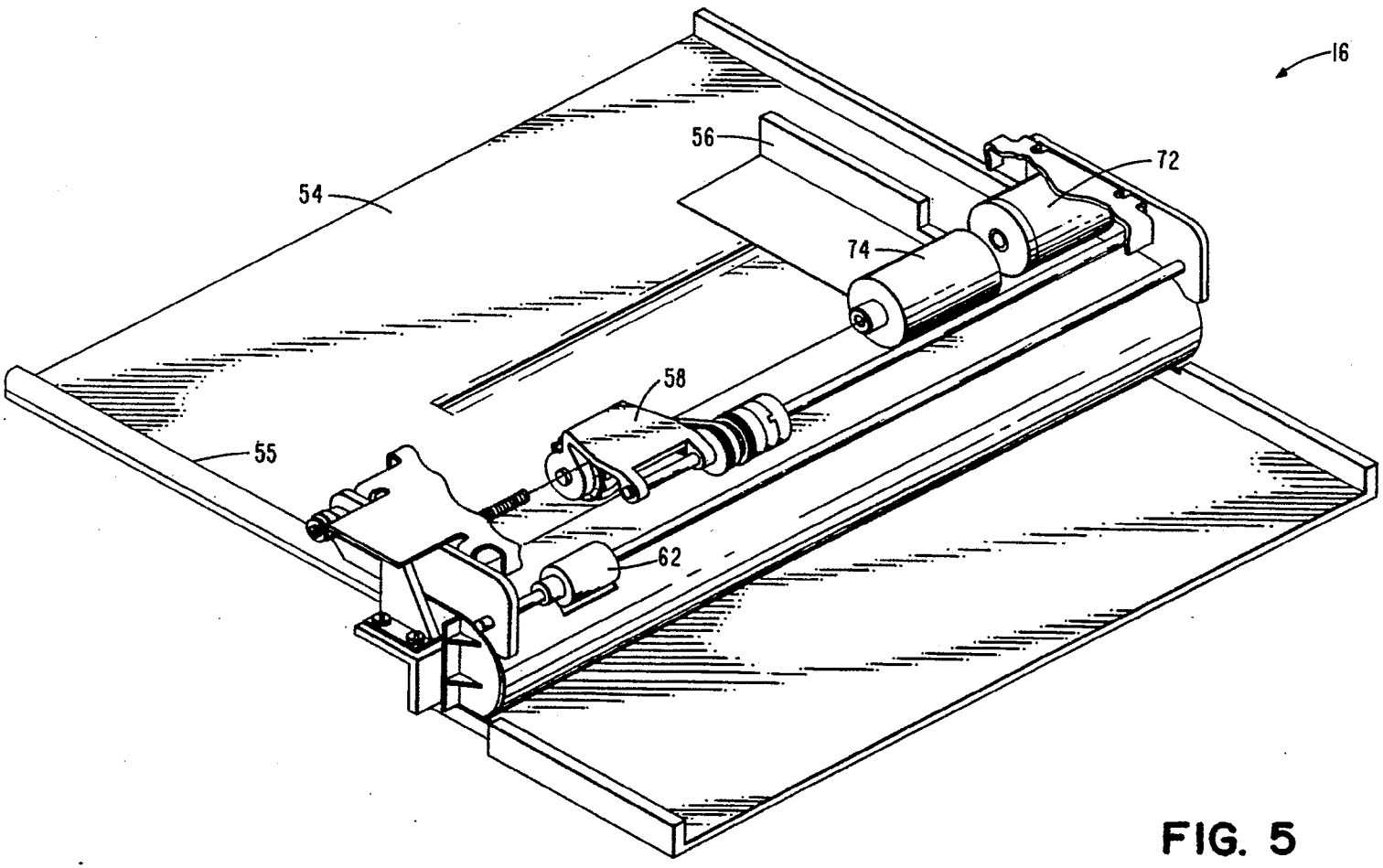
FIG. 5 is a top perspective view with housing partially removed of the automatic document feeding mechanism shown in FIG. 4.

As shown best in FIGS. 4 and 5, an automatic document feeding mechanism 16 is preferably provided. Mechanism 16 includes a document tray 54 for storage, or stacking, of originals thereon to be copied. As shown, tray 54 has a fixed front reference edge 55 and a movable rear reference 56 provided thereon. Each original is sequentially fed by paper feed roll 58 past automatic document feed gate 60 and nip rolls 62 to a gate 64 where each original is sequentially introduced into the copying area 18, and more particularly, positioned on glass platen 66 thereat by means of belt 68 mounted on rollers 70. As shown in FIG. 5, motor 72 drives the paper feed rolls and nip rolls while solenoid 74 is provided to lift the paper feed roll as necessary. Exit gate (and reference edge) 76 is also provided for removal of each original from the glass platen, or document glass, 66 (and hence from the copying area).

Figure 6:
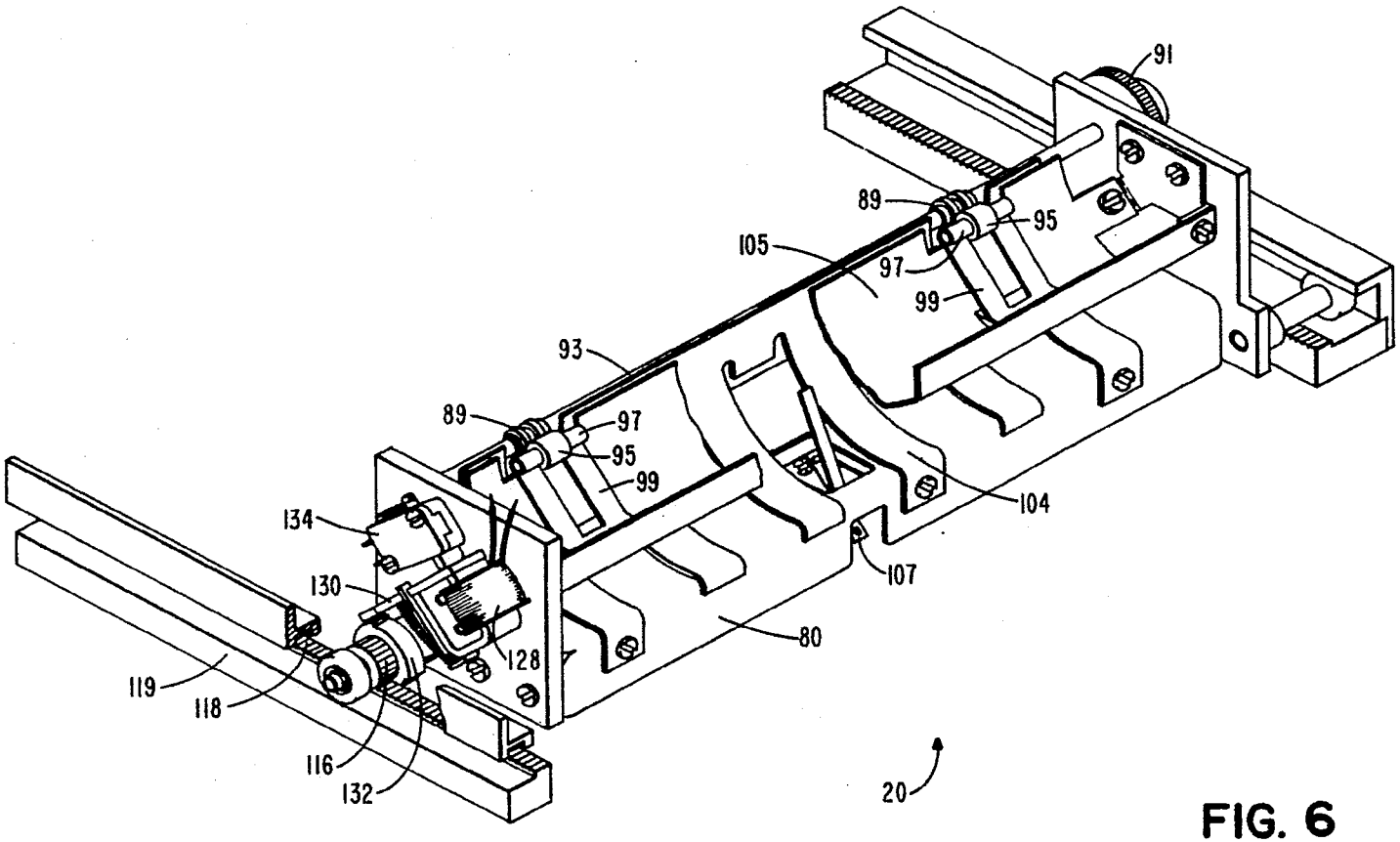
FIG. 6 is a top perspective view of the movable portion, or deflector mechanism, of the collator.
Figure 7:
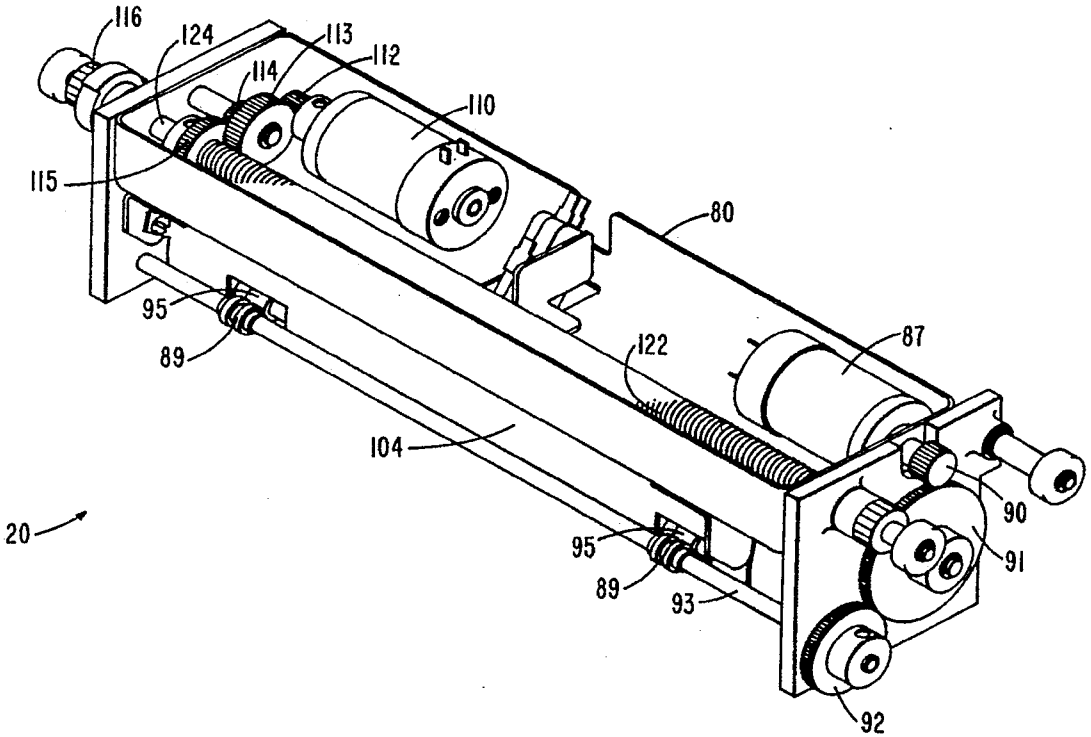
FIG. 7 is a perspective view showing the bottom side of the movable portion of the collator shown in FIG. 6.
Figure 8:
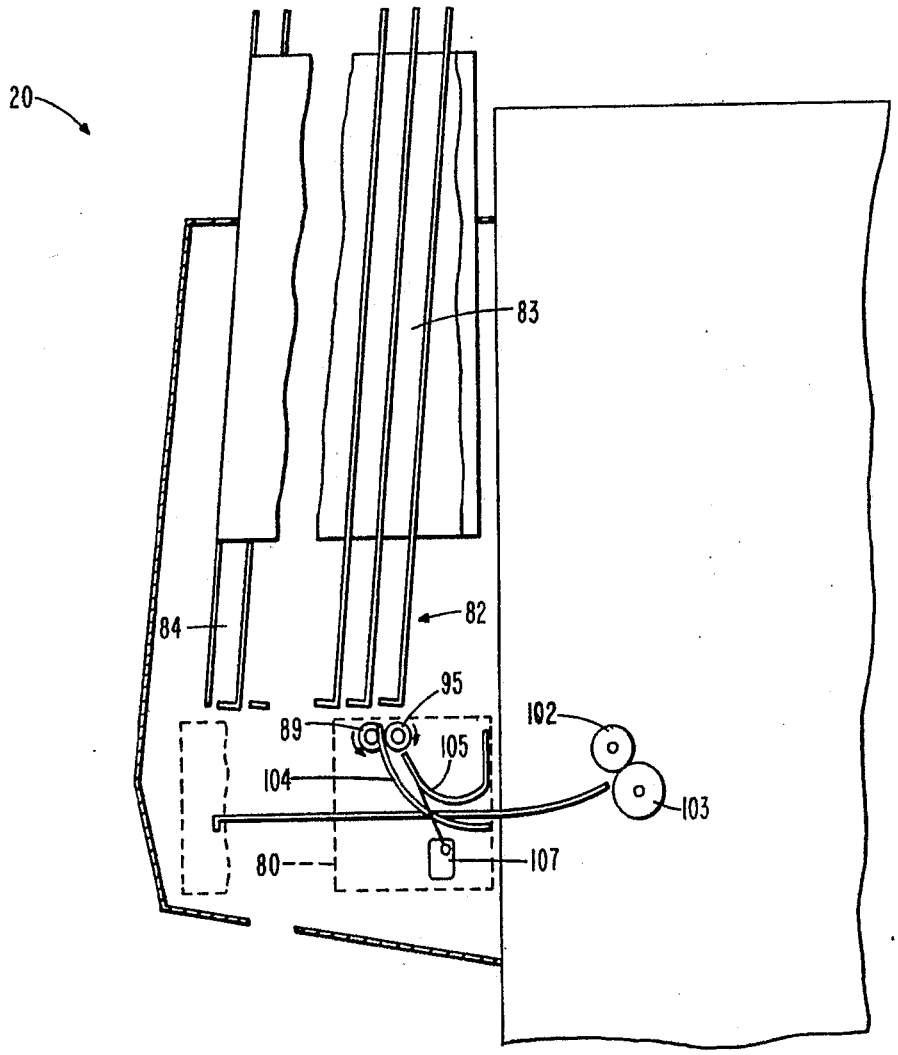
FIG. 8 is a partial side view illustrating the bins of the collator as used in conjunction with the movable portion.

As shown in FIGS. 6 through 8, collator 20 includes a movable deflector portion, or mechanism, 80 for receiving the sheets of copy paper from the copying area and directing the sheets to collecting area 82 which includes a plurality of bins which extend from the first bin 83 nearest the copy machine rearwardly to the last bin 84 positioned most remote from the copying machine.

Motor 87 (see FIG. 7) drives rollers 89 through gears 90, 91 and 92, the latter of which is mounted on rotatable shaft 93 having rollers 89 also mounted thereon. As shown in FIG. 6, rollers 95 are mounted on shafts 97 the opposite ends of each of which are mounted in biased mounting plates 99. The copy paper is received between rollers 89 and 95 with the paper thereon being conveyed to the proper bin at collating area 82. As also indicated in FIGS. 6 through 8, the copy paper passes between rollers 102 and 103 to curved plates 104 and 105 of the deflector mechanism before reaching rollers 89 and 95. A switch 107 is provided in the path of the copy paper between the curved plates 104 and 105. This switch senses paper presence and also can detect jams.

Deflector mechanism 80 is moved by motor 110 through gears 112, 113, 114, 115, and 116, as shown in FIG. 7, with gear 116 engaging a flat geared surface 118 on frame 119 of the copying machine (as shown in FIG. 6). By this arrangement, the collator can be incremented from bin to bin (as indicated by FIG. 8).

As also shown in FIG. 7, a torque spring 122 is wound about shaft 124 (having gear 115 mounted thereon). This torque spring is used to drive the deflector mechanism from bin 84 to bin 83 (i.e., from the most rearward bin to the nearest bin) when movement in this direction is needed. Solenoid 128 controls operator dog 130 to release ratchet 132 to permit movement of the deflector mechanism by the torque spring. In addition, as is also shown in FIG. 6, switch 134 is provided to ascertain the positioning of the deflector mechanism with respect to each bin of the collecting area by providing a count to the copy machine logic system.

Figure 9:
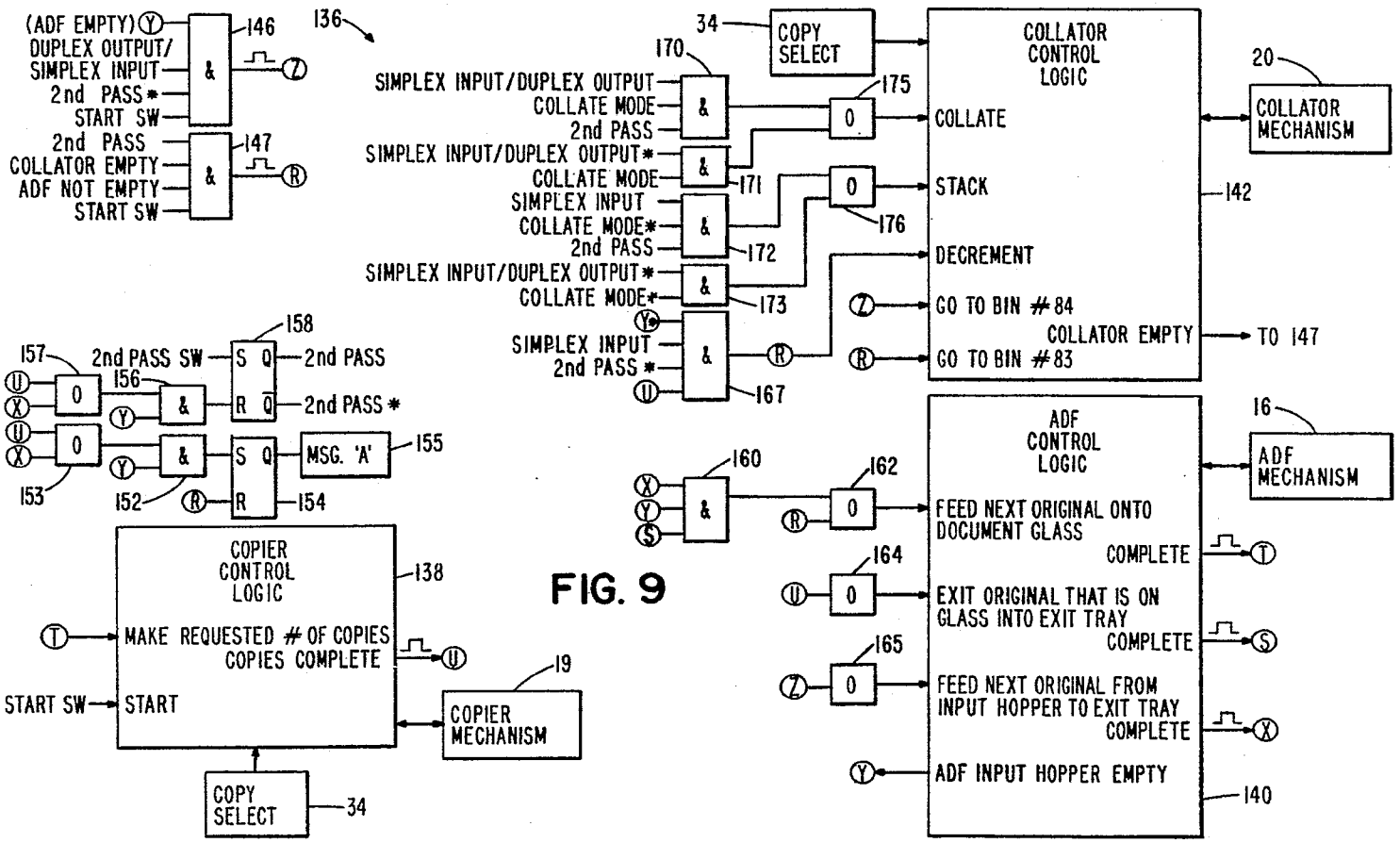
FIG. 9 is an electrical block and schematic diagram of the logic control system of this invention for enabling duplex copy generation.

A block and logic schematic diagram of the control system 136 of this invention, is shown in FIG. 9. As shown, the control system includes a copier control logic unit 138 connected with copier mechanism 19 to control operation thereof, an automatic document feed (ADF) control logic unit 140 connected with automatic document feeding (ADF) mechanism 16 to control operation thereof, and a collator control logic unit 142 connected with collator mechanism 20 to control the operation thereof.

Logic circuitry is connected with each of these control units as indicated in FIG. 9. As shown, the logic circuitry includes AND gates 146 and 147 each of which receives a plurality of inputs as indicated; AND gate 152 which is connected at one input to OR gate 153 and has its output connected to the set input of flip-flop 154, the Q output of which is connected to energize the special message light 155 at the control panel that is, at indicator 45 of control panel 25 of the copy machine, as shown in FIGS. 1 and 2; AND gate 156 which is connected at one input to OR gate 157 and has its output connected to the reset input of flip-flop 158, the Q output of which indicates a second pass of the original documents during the duplexing operation; AND gate 160 the output of which is connected with OR gate 162; OR gates 164 and 165 which along with OR gate 162 have their outputs connected with the automatic document feed control logic unit 140; and AND gate 167 which has its output connected to the collator control logic circuit 142.

The logic circuitry, as also shown in FIG. 9, also includes circuitry for establishing the collate or stacking mode for the duplex sets of copies. This circuitry includes a plurality of AND gates 170, 171, 172, and 173 each of which has a plurality of indicated inputs with the outputs of AND gates 170 and 171 being connected through OR gate 175 to the collator control logic circuit unit 142 and the outputs of AND gates 172 and 173 being connected through OR gate 176 to collator control logic unit 142.

Figure 10:
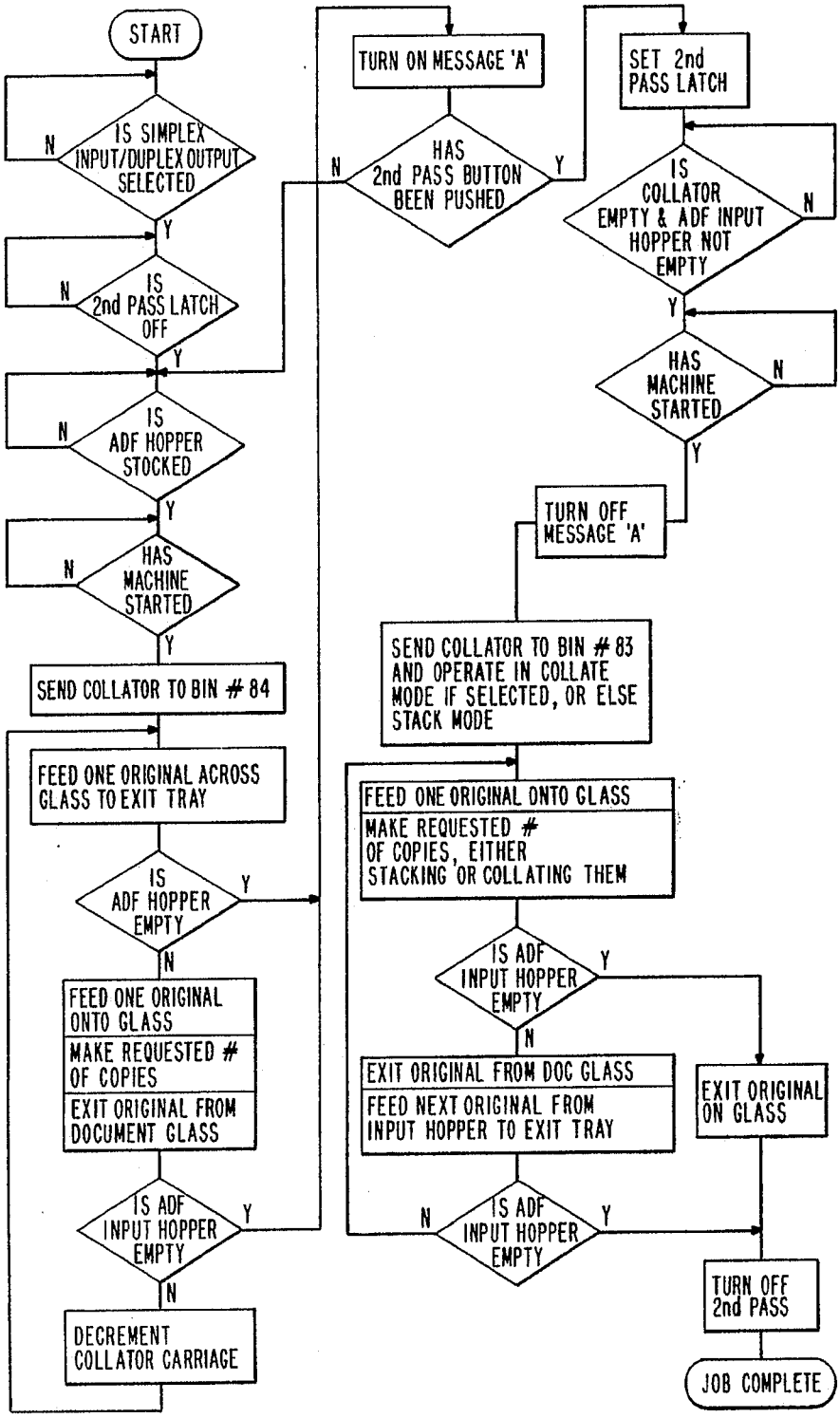
FIG. 10 is a flow diagram illustrating the invention.

Functioning of this control system is illustrated by the flow diagram of FIG. 10. As indicated, at AND gate 146 a determination is made as to whether the simplex input/duplex output is selected, whether the second pass latch is off, whether the automatic document feed hopper is stocked and whether the machine has started. If the answer is "yes" to all of the foregoing, then an output is coupled from AND gate 146 to the collator control logic unit 142 to cause the collator to be sent to the most remote bin, i.e., bin 84. In addition, a signal is sent to the automatic document feed control logic unit 140 to cause one original to be fed across the glass platen 66 to the exit tray (i.e., the first original is not copied but instead is sent across the copying area without the occurrence of copying). It can be seen from FIG. 9 that the output of AND gate 146 is coupled through OR gate 165 to cause the original to be fed from the input hopper to the output tray.

If the automatic document feed input hopper is not empty, an output from the automatic document feed control logic unit 140 is coupled through AND gate 160 and OR gate 162 to cause feeding of the next original in the sequence onto the glass platen 66. At this time, a signal from ADF control logic unit 140 is coupled to the copier control logic unit 138 to cause the requested number of copies to be made. When the required number of copies have been made, an output from the copier control logic unit 138 is coupled to the automatic document feed control logic unit 140 through OR gate 164 to cause the original then on the glass platen 66 to be exited into the exit tray.

If the automatic document feed input hopper is not then empty, a signal is coupled through AND gate 167 to the collator control logic unit 142 to cause the deflector mechanism to be decremented, that is, to be moved to the next bin. After this has occurred, the next original is fed across the glass to the exit tray (as indicated in the flow diagram of FIG. 10) and hence the next original (an odd numbered copy in the sequence) is not copied but is passed across the tray. The steps are then repeated for the next original (an even numbered original) that is moved onto the glass platen so that copies are made.

If the hopper is not yet empty, the collator control logic unit 142 causes the deflector mechanism to be decremented to the next bin and the process is continued with copying of even numbered documents and passing odd numbered documents until such time as the hopper is indicated to be empty. At this point, an output is coupled to display message A on the instrument panel (as by lighting the same). Message A can, for example, instruct the operator to remove the copies from the collator and position them as shown in a paper drawer or tray, after which the operator is further instructed to then press the second pass button, close the drawer, remove the originals from the automatic document feed exit tray and place them in the automatic document feed input hopper, and then press the start print button.

The first pass having now been completed, the second pass of the documents is commenced. As indicated in the flow diagram of FIG. 10, the first test is whether the second pass button has been pressed. If so, the Q output from flip-flop 158 is provided for indicating second pass and is coupled as one input to AND gate 147. If the collator is empty, if the automatic document feeding mechanism is not empty, and if the start switch is on, then an output is coupled from AND gate 147 to turn off the message display. This output is also coupled to the collator control logic unit 142 to cause the deflector mechanism of the collator to be moved to the bin nearest the copy machine (that is, to bin 83). At this time, the mode selected determines whether the collator will collate the duplex copies or stack the same (see FIG. 9).

The first original is then fed onto the glass platen 66 (due to the signal through AND gate 160 and OR gate 162 to the automatic document feed control logic unit 140) and the requested number of copies are made in the same manner as described hereinabove with respect to the first pass.

After these copies are made, if the automatic document feed mechanism input hopper is not then empty, the next original (an even numbered original) is caused to be moved onto and off of the glass platen in the same manner that the first original was moved onto and off the glass in the first pass (i.e., the second original rather than the first and each even numbered original thereafter is moved across the glass without copying during the second pass). If the ADF input hopper is then not yet empty, the procedure is then repeated with each succeeding odd numbered original being moved onto the glass and copied and each succeeding even numbered original being passed without copying.

After all of the originals have been removed from the automatic document feeding input hopper, an indication of the hopper being empty appears and the second pass is completed. As indicated in FIG. 10, the copying job is then complete. The duplex copies can then be removed from the collator and are either collated into sets or stacked depending upon the mode selected.

In operation, the operator would select the duplex button and the number of copies desired before copying is commenced. The copying process is then initiated by "gang feeding" all of the originals into the automatic document feeding mechanism which works in an automatic mode. Each original is in its natural order (for example, 1 through 7 if there are 7 originals). As shown above, no copies are made of the odd numbered originals during the first pass through the automatic document feeding mechanism (they are shuttled across the glass platen and out of the copying area without making any copies because of the special machine programming associated with the duplex selection). The copying machine does make, however, the appropriate number of copies of each of the even numbered originals during this first pass as "side two" copies. The machine logic is programmed to stack the copies in reverse order from normal in the collator when the duplex mode has been selected and first pass copies are being generated. Thus, copies of original number 6 are stacked in bin 84 of the collator and copies of the original number 4 are stacked in the adjacent bin of the collator, etc. where seven originals are being copied.

After all the originals have passed through the automatic document feed mechanism, the operator removes the copies (of the even numbered originals) and places them in their proper orientation back into the same paper tray used in making these copies. The job is completed, including collating the copies (if the collate mode is selected) by again passing the originals through automatic document feeding mechanism. During this second pass, "side one" copies are made only of the odd numbered originals and the even numbered originals are merely shuttled across the glass platen without making copies (due to the machine logic associated with this invention).

While not specifically described, it is to be realized that modifications of the described embodiment might be made as, for example, for duplex printing by printing each even numbered page in sequence for each duplicate set to be produced and then printing each odd numbered page in sequence for each duplicate set to be produced on the opposite side of each even numbered page. This invention can be readily incorporated into both new and existing equipment, and particularly into existing equipment with either automatic document feeding or semi-automatic document feeding.

As can be appreciated from the foregoing, the method and apparatus of this invention requires little handling of originals and/or copies thereof by an operator and simplifies the required mental steps which must be taken by such an operator. In addition, little additional cost is encountered in order to implement the invention.

It should also be understood that control exercised over the machine components in the performance of the method of this invention can be obtained through the provision of a programmed computer or microprocessor following the dictates of FIG. 10. An exemplary copier, including a computer, is disclosed in U.S. Pat. No. 4,086,658, issued Apr. 25, 1978, and incorporated herein by reference. Preparation of appropriate programming is well within the skill of the art as represented by "MICROPROGRAMMING, PRINCIPLES AND PRACTICES" by Samir S. Husson, published by Prentice-Hall, Englewood Cliffs, New Jersey, 1970, and by the many publications of the Institute of Electrical and Electronics Engineers.

What is claimed is:

1. A method for generating duplex copies from simplex original sheets to be copied, said method comprising:

providing a plurality of original sheets each of which has a side to be copied;

sequentially feeding said plurality of original sheets through a copying device with said original sheets being fed therethrough by alternating first and second groups with each said group including different ones of said original sheets to be copied;

causing only said first group of original sheets sequentially fed through said copying device to be copied with each of said original sheets in said first group being copied on one side of separate dual-sided copy material;

repeating said sequential feeding of said plurality of original sheets through said copying device; and causing only said second group of original sheets sequentially refed through said copying machine to be copied with each of said original sheets in said second group being copied on the other side of said dual-sided copy material.

2. The method of claim 1 wherein said duplex copies are electrophotographically produced.

3. The method of claim 1 wherein said plurality of sheets include a multi-paged document, and wherein said pages are sequentially fed through said copying device with the odd and even pages constituting said groups alternately fed through said copying device.

4. The method of claim 3 wherein said one group includes the even pages of said document and the other of said groups includes the odd pages of said document.

5. A method for generating duplex copies from simplex original sheets to be copied, said method comprising:

providing a plurality of original sheets each of which has a side to be copied;

sequentially feeding said plurality of original sheets through a copying device with said original sheets being fed therethrough by alternating first and second groups with each said group including different ones of said original sheets to be copied;

causing only said first group of original sheets sequentially fed through said copying device to be copied with each of said original sheets of said first group being copied on one side of a preselected plurality of sheets of separate dual-sided copy paper;

repeating said sequential feeding of said plurality of original sheets through said copying device; and causing only said second group of original sheets sequentially refed through said copying machine to be copied with each of said original sheets of said second group being copied on the other side of said preselected plurality of sheets of copy paper.

6. The method of claim 5 wherein each of said preselected plurality of sheets of copy paper are collated by sets after said repeated sequential feeding of said items through said copying device to thereby produce a preselected plurality of duplex sets of copied sheets.

7. A method for generating electrophotographic duplex copies from simplex originals to be copied, said method comprising;

providing a plurality of simplex originals to be electrophotographically copied, said originals being grouped into a group of even pages and a group of odd pages with each group to be copied on opposite sides of copy paper;

stacking said plurality of simplex originals in a feeding device with said originals being oriented so that said groups of pages are alternated when sequentially fed to a copying device;

sequentially feeding said plurality of simplex originals to a copying device;

causing each of one group of pages of said simplex originals to be electrophotographically copied on one side of separate sheets of copy paper;

repeating said sequential feeding of said simplex originals to said copying device; and causing each of the other group of pages of said simplex originals to be electrophotographically copied on the opposite side of said separate sheets of copy paper.

8. The method of claim 7 wherein said group of even pages of said simplex originals are copied during said first sequential feeding of said simplex originals to said copying device, and wherein said group of odd pages are copied during said repeat sequential feeding of said simplex originals to said copying device.

9. A method for generating electrophotographic duplex copies from simplex originals to be copied, said method comprising:

providing a plurality of simplex originals to be electrophotographically copied, said originals being grouped into a group of even pages and a group of odd pages with each group to be copied on opposite sides of copy paper;

stacking said plurality of simplex originals in a feeding device with said originals being oriented so that said groups of pages are alternated when sequentially fed to a copying device;

sequentially feeding said plurality of simplex originals to a copying device;

causing each of said group of pages of said simplex originals to be electrophotographically copied on one side of separate sheets of copy paper withdrawn from a storage receptable during copying of said one group of pages;

collecting said sheets of copy paper and returning said sheets to said storage receptacle after copying of said one group of pages;

repeating said sequential feeding of said simplex originals to said copying device; and causing each of the other group of pages of said simplex originals to be electrophotographically copied on the opposite side of said sheets of copy paper during said refeeding of said simplex originals through said copying device.

10. The method of claim 9 wherein said sheets of copy paper are collected and placed in storage receptacles so that adjacent even and odd pages appear at the opposite sides of said produced duplex copies.

11. A method for generating electrophotographic duplex copies from simplex originals to be copied, said method comprising:

providing a plurality of simplex originals to be electrophotographically copied, said originals being grouped into a group of even pages and a group of odd pages with each group to be copied on opposite sides of copy paper;

stacking said plurality of simplex originals in a feeding device with said originals being oriented so that said groups of pages are alternated when sequentially fed to a copying device;

sequentially feeding said plurality of simplex originals to a copying device;

causing each of said group of even pages to be electrophotographically copied on one side of a preselected plurality of separate sheets of copy paper;

repeating said sequential feeding of said simplex originals to said copying device;

causing each of said group of odd pages to be electrophotographically copied on the opposite side of each of said preselected plurality of separate sheets of copy paper; and collating said sheets of copy paper after copying on both sides to produce a preselected number of sets of duplex copies.

12. A method for generating duplex copies electrophotographically from simplex originals to be copied, said method comprising:

providing a plurality of simplex originals to be copied, said originals being grouped into a group of even pages and a group of odd pages with each group to be copied on opposite sides of copy paper;

stacking said plurality of simplex originals in a feeding device with said originals being oriented so that said group of pages are alternately sequentially fed from the feeding device;

providing a storage receptacle with copy paper;

feeding said simplex originals from the feeding device to an electrophotographic copying machine;

electrophotographically copying only the pages of one group of simplex originals fed from said feeding device with each of the pages of said one group being copied on a predetermined number of separate sheets of copy paper withdrawn from said storage receptacle;

collecting the sheets of copy paper having the pages of said one group copied thereon and returning the same to said storage receptacle for copying on the other side of each of said sheets;

refeeding said simplex originals from the feeding device to said copying machine;

electrophotographically copying the pages of the other group of simplex originals fed from said feeding device with each of the pages of the other group being copied on the opposite side of said predetermined number of separate sheets withdrawn from said storage receptacle; and collating said sheets of copy paper twice withdrawn from said storage receptacle to produce a predetermined number of sets of duplex copies.

13. The method of claim 12 wherein the first of said simplex originals and every other one thereafter fed to said copying device is removed from the copying device without copying during the first sequential feeding of originals from said feeding device to said copying device, and wherein the second of said simplex originals and every other one thereafter fed to said copying device is removed from the copying device without copying during refeeding of said originals from said feeding device to said copying device.

14. The method of claim 13 wherein said first of said simplex originals and every other one thereafter are odd pages, and wherein said second of said simplex originals and every other one thereafter are even pages.

15. The method of claim 12 wherein each group of said predetermined number of sheets of copy paper are separately collected, after the pages of said first group have been copied, rearwardly to forwardly in different bins.

16. A device for generating duplex copies from simplex originals, said device comprising:

electrophotographic copying means having a copying area;

feeding means for twice sequentially feeding a plurality of originals through said copying area;

storage receptacle means for storing sheets of copy paper;

means for supplying said sheets of copy paper from said storage receptacle means to said copying area;

means for collecting said sheets of copy paper after copying has occurred at said copying area; and control means for causing, during a first feed of originals through said copying area, first alternate ones of said originals to be copied on one side of separate sheets of said copy paper, and causing, during a second feed of originals through said copying area, second alternate ones of said originals different from said first alternate ones to be copied on the other side of said separate sheets of said copy paper when replaced in said storage receptacle means before said second feed of said second originals through said copying area.

17. The device of claim 16 wherein said feeding means is an automatic feeding means for sequentially feeding each of said originals through said copying area of said copying means.

18. The device of claim 16 wherein said collecting means includes a plurality of bins for collecting said sheets of copy paper from said copying area in a preselected manner.

19. The device of claim 16 wherein said control means includes a plurality of logic circuits.

20. A device for generating duplex copies from simplex originals, said device comprising:

electrophotographic copying means having a copying area;

feeding means for twice sequentially feeding a plurality of originals through said copying area;

storage receptacle means for storing sheets of copy paper;

means for supplying said sheets of copy paper from said storage receptacle means to said copying area;

means for collecting said sheets of copy paper after copying has occurred at said copying area; and control means including a plurality of logic gates for causing a predetermined number of copies of each of first alternate ones of said originals to be made on one side of separate sheets of said copy paper during a first feed of said originals through said copying area, and causing copying of second alternate ones of said originals different from said first alternate ones on the opposite side of said predetermined number of copies during a second feed of said originals through said copying area when said copy paper is replaced in said storage receptacle before said second feed of said originals through said copying area.

21. The device of claim 20 wherein said collecting means includes a plurality of bins, and wherein said control means causes such copy paper to be collected by duplex sets in said bins.

22. A control system for a copying machine having feeding and collating mechanisms and producing duplex copies from simplex originals at a copying area, said control system comprising:

feeding mechanism control means for controlling feeding of originals by said feeding mechanism through the copying area of said copying machine;

copy mechanism control means for controlling copying of originals fed by said feeding mechanism to the copying area of said copying machine;

collating mechanism control means for controlling collection of sheets of copy paper from said copying area of said copying machine;

start means for causing said feeding mechanism to sequentially feed each of said originals through said copying means; and logic means connected with said copy mechanism control means and said feeding mechanism control means for causing a first group, consisting of every other original, in the sequence fed to the copying area from said feeding mechanism, to be copied on one side of a predetermined plural number of sheets of copy paper during a first sequential feed of said originals to said copying area, and causing a second group, consisting of every other original in sequence and different from the originals of said first group, to be copied on the other side of said predetermined plural number of sheets of copy paper during a second pass of said originals through said copying area, said logic means also being connected with said collating control means to cause collection of said sheets of copy paper from said copying area during each sequential feed of originals through said copying area.

23. The control system of claim 22 wherein said logic means includes gate means connected to said feeding mechanism control means, copy mechanism control means, and collating mechanism control means.

24. The control system of claim 22 wherein said collecting means includes a plurality of bins, and wherein said logic means causes said predetermined number of copies of said copy paper to be inserted in a predetermined order in said bins.

25. The control system of claim 24 wherein said plurality of bins extend rearwardly from a predetermined forward position, and wherein said logic means causes said predetermined number of sheets of copy paper to be collected rearwardly to forwardly in said bins during said first sequential feeding of said originals through said copying area.

26. The control system of claim 24 wherein said logic means causes said preselected number of sheets of said copy paper to be collated into sets of duplex copies during said second sequential feeding of said originals through said copying area.

27. The control system of claim 23 wherein said logic means causes said predetermined number of sheets of said copy paper to be stacked during said second sequential feeding of said original through said copying area.

28. The control system of claim 23 wherein said logic means causes a message indication to be displayed after said first sequencing of said originals through said copying area.

29. A control system for an electrophotographic copying machine having feeding and collating mechanisms and producing duplex copies from simplex original documents at a copying area, said control system comprising:

document feeding control logic means for causing, during each pass, sequential feeding of all original documents at said feeding mechanism to and from the copying area of said copying machine;

copier control logic means for controlling copying of documents at said copying area on copy paper withdrawn from a copy paper storage receptacle;

collating control logic means for controlling collection of said copy paper from said copying area after copying has occurred; and a first plurality of logic gate means connected with said document feeding control logic means and said copier control means for controlling copying to cause, during a first pass of documents through said copying area, copying on a predetermined number of separate sheets of copy paper only those documents appearing at an even number in the sequence, and causing, during a second pass of documents through said copying area, copying on the opposite side of said separate sheets of copy paper when replaced in said storage receptacle to be withdrawn therefrom, only those documents appearing at an odd number in the sequence; and a second plurality of logic gate means connected with said collator control logic means for controlling the manner of collecting of said sheets of copy paper from said copying area after copying has occurred.

* * * * *